US005219523A

United States Patent [19]

Vanderpool et al.

[11] Patent Number: 5,219,523

[45] Date of Patent: Jun. 15, 1993

[54] COPPER AND COPPER ALLOY CORROSION INHIBITORS

[75] Inventors: Daniel P. Vanderpool, Coraopolis; Charles Y. Cha, McMurray, both of Pa.

[73] Assignee: Calgon Corporation, PittsburghPA

[21] Appl. No.: 865,440

[22] Filed: Apr. 9, 1992

Related U.S. Application Data

[63] Continuation of Ser. No. 348,532, May 8, 1989, abandoned.

[51] Int. Cl.[5] ..... C23F 11/00

[52] U.S. Cl. ..... 422/16; 528/259; 252/392; 252/394; 106/14.05; 106/14.16

[58] Field of Search ..... 422/16; 528/259; 252/392, 394; 106/14.05, 14.16

[56] References Cited

U.S. PATENT DOCUMENTS

| | | | |
|---|---|---|---|
| 2,861,078 | 11/1958 | Miller et al. | 548/257 |
| 3,413,227 | 11/1968 | Howard et al. | 252/51.5 R |
| 3,673,186 | 6/1972 | Cyba | 544/401 |
| 3,720,616 | 3/1973 | Randell et al. | 106/14.16 |
| 3,720,696 | 1/1973 | Osawa | 554/185 |
| 3,839,334 | 10/1974 | Cyba | 252/397 |
| 4,315,889 | 2/1982 | McChesney et al. | 252/392 |
| 4,392,994 | 6/1983 | Wagener | 252/602 |
| 4,406,811 | 9/1983 | Christensen et al. | 252/180 |
| 4,522,785 | 6/1985 | D'Errico | 252/392 |
| 4,675,158 | 6/1987 | Klindera | 422/16 |
| 4,744,950 | 5/1988 | Hollander | 422/16 |

FOREIGN PATENT DOCUMENTS

| | | |
|---|---|---|
| 55-108861 | 9/1980 | |
| 0173427 | 3/1986 | European Pat. Off. . |
| 258021 | 6/1989 | European Pat. Off. . |
| 2093771 | 8/1977 | Japan . |

OTHER PUBLICATIONS

C.A. 102:153153b (Japanese Kokai 59,222,589 (1984)).

*Primary Examiner*—Robert J. Warden
*Assistant Examiner*—Laura E. Collins
*Attorney, Agent, or Firm*—W. C. Mitchell; C. M. Caruso

[57] ABSTRACT

The use of alkoxybenzotriazoles to inhibit the corrosion of metallic surfaces in contact with an aqueous system. Systems and compositions containing alkoxybenzotriazole are also claimed.

6 Claims, No Drawings

COPPER AND COPPER ALLOY CORROSION INHIBITORS

This is a continuation of application Ser. No. 348,532, filed May 8, 1989, now abandoned.

BACKGROUND OF THE INVENTION

Benzotriazole, mercaptobenzothiazole and tolyltriazole are well known copper corrosion inhibitors. For example, see U.S. Pat. No. 4,675,158 and the references cited therein. Also, see U.S. Pat. No. 4,744,950, which discloses the use of alkoxybenzotriazoles as corrosion inhibitors and U.S. Pat. No. 4,406,811, which discloses the use of benzotriazole/tolyltriazole blends in water treatment compositions for multimetal corrosion inhibition. Aside from the known use of 5-methoxybenzotriazole (anisotriazole) in corrosion inhibition compositions (see Japan Kokai Tokkyo Koho, JP 59,222,589; Dec. 14, 1984; Chem. Abst. 102:153153b.), the use of alkoxybenzotriazoles is not known in the water treatment art.

The instant invention relates to the use of alkoxybenzotriazoles as corrosion inhibitors, particularly copper and copper alloy corrosion inhibitors. These compounds from long-lasting protective films on metallic surfaces, particularly copper and copper alloy surfaces, in contact with aqueous systems.

DESCRIPTION OF THE INVENTION

The instant invention is directed to a method of inhibiting the corrosion of metallic surfaces, particularly copper and copper alloy surfaces, in contact with an aqueous system, comprising adding to the aqueous system being treated an effective amount of a compound having the following structure:

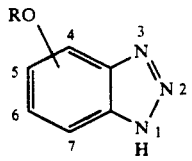

wherein R is any straight or branched, substituted or unsubstituted alkoxy group having 3–18 carbons, and isomers of such compounds.

The instant invention is also directed to an aqueous system which is in contact with a metallic surface, particularly a copper or copper alloy surface, and which contains an alkoxybenzotriazole.

Compositions comprising water, particularly cooling water, and an alkoxybenzotriazole are also claimed.

The inventors have discovered that alkoxybenzotrizoles are effective corrosion inhibitors. These compounds form durable, long-lasting films on metallic surfaces, including but not limited to copper and copper alloy surfaces. Alkoxybenzotriazoles are especially effective inhibitors of copper and copper alloy corrosion, and can be used to protect multimetal systems, especially those containing copper or a copper alloy and one or more other metals.

The instant inventors have also found that alkoxybenzotriazoles de-activate soluble copper ions, which prevents the galvanic deposition of copper which concomminantly occurs with the galvanic dissolution of iron or aluminum in the presence of copper ions. This minimizes aluminum and iron corrosion. These compounds also indirectly limit the above galvanic reaction by preventing the formation of soluble copper ions due to the corrosion of copper and copper alloys.

Isomers of the above described 5-alkoxybenzotriazoles can also be used. The 5 and 6 isomers are interchangeable by a simple prototropic shift of the 1 position hydrogen to the 3 position and are believed to be functionally equivalent. The 4 and 7 isomers are believed to function as well as or better than the 5 or 6 isomers, though they are more difficult and expensive to manufacture. As used herein, the term "alkoxybenzotriazoles" is intended to mean 5-alkoxybenzotriazoles and 4, 6 and 7 position isomers thereof.

Substituted alkoxybenzotriazoles and their isomers can also be used. Thus, one or more of the $CH_2$ groups in R of structure I when R is an unsubstituted alkoxy group of 3–18 carbons may be replaced by an O or NH. Specific examples include, but are not limited to, the oxapentyl group ($CH_3CH_2OCH_2CH_2$—), the azapentyl group ($CH_3CH_2NHCH_2CH_2$—) and the 6-oxa-3-azaoctyl group ($CH_3CH_2OCH_2CH_2NHCH_2CH_2$—). As used herein, the term "substituted alkoxybenzotriazoles" includes compounds wherein R of structure I is any oxa and/or aza alkoxy group. Substituted alkoxybenzotriazoles also include compounds wherein R of structure I contains halogenomethylene group, $CH_yX_z$, where y is 1 or 0 and z is 1 or 2, x is a group VII element, and x can be either the same or a different halogen. Also, one or more of the methylene groups may be substituted with oxygen or sulfur resulting in for example an alcohol, thioalcohol, keto or thioketo group. The carbon of the ether linkage should be unsubstituted. Also one or more pairs of methylene groups may be unsaturated, resulting in an ethylene or acetylene unit. Substituted alkoxybenzotriazoles also include compounds wherein R of structure I contains an aromatic group. Particular examples include, but are not limited to, compounds wherein R is:

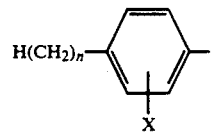

wherein n is 1–9 and X is H, halageno, nitro, carboxy, cyano, amido, substituted amino or $C_1$–$C_3$ alkoxy; and compounds where R is:

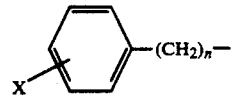

wherein n is 1–8, and x is as above.

An effective amount of an instant alkoxybenzotriazole should be used. As used herein, the term "effective amount" refers to that amount of an alkoxybenzotriazole which effectively inhibits corrosion in a given aqueous system.

More particularly, the alkoxybenzotriazoles, substituted alkoxybenzotriazoles and isomers thereof of the present invention effectively inhibit the corrosion of metallic surfaces, especially copper and copper alloy surfaces, when added to an aqueous system in contact with such surfaces at a concentration of at least about 0.1 ppm, preferably about 0.5 to 100 ppm and most preferably about 1-10 ppm. Maximum concentrations are determined by the economic considerations of the particular application, while minimum concentrations are determined by operating conditions such as pH, dissolved solids and temperature.

The instant alkoxybenzotriazoles may be prepared by any known method. For example, the instant alkoxy benzotriazoles may be prepared by contacting a 4-alkoxy-1,2-diaminobenzene with an aqueous solution of sodium nitrite in the presence of an acid, e.g., sulfuric acid, and then separating the resultant oily product from the aqueous solution. The 4-alkoxy-1,2-diaminobenzene may be obtained from any number of sources.

The instant compounds can be used as water treatment additives for industrial cooling water systems, gas scrubber systems or any water system which is in contact with a metallic surface, particularly surfaces containing copper and/or copper alloys. They can be fed alone or as part of a treatment package which includes, but is not limited to, biocides, scale inhibitors, dispersants, defoamers and other corrosion inhibitors. The instant alkoxybenzotriazoles and substituted alkoxybenzotriazoles can be fed intermittantly or continuously.

Treatment of cooling water which contacts copper or copper alloy surfaces, such as admiralty brass or 90/10 copper-nickel, requires the use of specific copper inhibitors. These inhibitors:

1. minimize the corrosion of the copper or copper alloy surfaces, including general corrosion, dealloying and galvanic corrosion; and
2. minimize problems of galvanic "plating out" of soluble copper ions onto iron or aluminum. Thus, soluble copper ions can enhance the corrosion of iron and/or aluminum components in contact with aqueous systems. This occurs through the reduction of copper ions by iron or aluminum metal, which is concommitantly oxidized, resulting in the "plating-out" of copper metal onto the iron surface. This chemical reaction not only destroys the iron or aluminum protective film but creates local galvanic cells which can cause pitting corrosion of iron or aluminum.

Conventional copper inhibitors such as tolyltriazole, benzotriazole, and 2-mercaptobenzothiazole are commonly used as copper inhibitors in aqueous systems. They are generally fed continuously because of the limited durability of their protective films.

Continuous feed of an inhibitor generally makes it uneconomical to apply these conventional inhibitors to once-through systems or systems with high blowdown rates. Additionally, conventional inhibitors provide only limited protection against chlorine induced corrosion.

While 5-alkoxybenzotriazoles are known which do not require continuous feeding in order to inhibit copper corrosion (See U.S. Pat. No. 4,744,950), these alkoxybenzotriazoles are relatively hard to produce and therefore only find limited application for economic reasons. Another disadvantage is their relatively slow rate of passivation of copper alloys in some waters, their failure to passivate copper in high dissolved-solids waters, and their limited chemical resistance to chlorine.

An object of the instant invention is to provide inhibitors which produce durable protective films, and which overcome the above-described limitations.

These objects are achieved through the use of alkoxybenzotriazoles, substituted alkoxybenzotriazoles and isomers of these compounds to minimize corrosion and/or to provide protective, durable hydrophobic films on metallic surfaces, especially copper and copper alloy surfaces.

The instant alkoxybenzotriazoles allow intermittent feed to cooling water systems. Depending on water aggressiveness, the time between feedings may range from several days to months. This results in an average lower inhibitor requirement and provides advantages relative to waste treatment and environmental impact.

The preferred alkoxybenzotriazoles are within the range of propyloxybenzotriazole to nonyloxybenzotriazole. The most preferred compounds are butyloxybenzotriazole, pentoxybenzotriazole and hexyloxybenzotriazole.

EXAMPLES

The following examples demonstrate the effectiveness of the instant compounds as copper and copper alloy corrosion inhibitors. They are not, however, intended to limit the scope of the invention in any way.

EXAMPLES 1-4

Film Persistency

In these examples, copper specimens were pretreated by immersing them in aerated water at pH 7.5° and 50° C. This water contained a specified concentration of inhibitor, which formed a protective film on the specimens.

After 24 hours, the specimens were transferred to inhibitor-free water of a highly corrosive nature to determine film persistency. Corrosion rates were measured using linear polarization to determine passivation.

The characteristics of the pretreatment water and the aggressive water are given in Tables I and II, respectively.

Corrosion results are given in Table III. The results are reported as "Corrosion Rates After Passivation" for the passivation step and as "Corrosion Rates In Inhibitor-Free Agressive Water".

The maximum duration of any test was 15 days at which time the experiment was terminated.

TABLE I

| Composition of Pretreatment Water pH = 7.5 | |
|---|---|
| Ion | Concentration (mg/L) |
| Ca | 88 |
| Mg | 24 |
| Cl | 70 |
| $SO_4$ | 325 |

TABLE II

| Composition of Aggressive Water pH = 7.5 | |
|---|---|
| Ion | Concentration (mg/L) |
| Ca | 750 as $Ca^{+2}$ |
| Mg | 130 as $Mg^{+2}$ |
| Cl | 2400 |
| $SO_4$ | 3200 |

TABLE III

| Inhibitor | Concentration (mg/L) | Passivation and Persistency Tests: mpy Corrosion Rate after 24 hrs. pretreatment | mpy Corrosion Rate in inhibitor-free Aggressive Water | No. of days in inhibitor-free Aggressive Water |
|---|---|---|---|---|
| None | 0 | 1.1 | 2.5–3.0 | 15 |
| 5-ethyloxybenzotriazole | 5 | 0.01 | 3.2 | 2 |
| Tolyltriazole | 5 | 0.01 | 5–6 | 1 |
| 5-pentyloxybenzotriazole | 3 | 0.005 | 0.03 | 15 |

Table III shows that 5-pentyloxybenzotriazole provided 99% inhibition, even after 15 days exposure to aggressive water, while the ethyloxybenzotriazole film lasted less than 2 days, and tolyltriazole, a conventional inhibitor, failed within one day.

EXAMPLES 5–8

Chlorine Resistence

These examples, which were run in a dynamic test unit, demonstrate the resistance of protective films formed by alkoxybenzotriazoles to corrosiveness caused by chlorine on heat-transfer brass tubes and on immersed copper coupons.

The dynamic test unit for these examples consisted of an 8L reservoir, a heater-circulator and a coil heater to provide the desired heat flux. The coil heater was designed to fit securely around the ⅜" OD tubes used in the tests. Flow through the tube was monitored by an in-line rotameter having a flow capacity of 400 ml/min. The power input to the heater was controlled by a rheostat, which made it possible to vary temperature differences across the tubes. The tube inlet and outlet temperatures were monitored by thermocouples attached to a digital readout having an accuracy of 0.1° F. The system was entirely enclosed to minimize evaporation. The linear velocity through the heated tubes was 2.2 fps, which gave a $N_{Re}$ of approximately 9350. Heat fluxes of 8,000–10,000 Btu/hr-ft$^2$ were chosen as being representative of industrial practices.

The corrosion rates of the heated tubes were determined by the weight loss method described in "Standard Practice for Preparing, Cleaning and Evaluating Corrosion Test Specimens"; ASTM designation G1-81. The corrosion rates of immersed specimens were determined by linear-polarization using a Petrolite Model M1010 Corrosion Data Acquisition System. This method measures the corrosion rate at a particular time, and is thus useful for following the immediate effects of chlorine concentration on corrosion rates.

The following procedure was followed relative to the test specimens:

1. Cleaned specimens were placed in the test unit described above, and a specified amount of inhibitor was added. The specimens were then allowed to passivate for 24 hours at which time they were placed in inhibitor-free water.
2. Chlorine was added to give an initial concentration of 1 mg/L free chlorine. The corrosion rate of each specimen was monitored for one hour. The chlorine concentration normally decreased from 1 mg/L to about 0.7 mg/L during this time.
3. After one hour, each specimen was placed in fresh inhibitor-free, chlorine-free water. The decrease in corrosion rate, i.e. the recovery corrosion rate, was then measured for each specimen.
4. Steps 2 and 3 were repeated in 24 hour cycles for a total of four cycles, with one additional cycle following a weekend period.
5. After a seven day period, the weight loss of the heated tube was determined.

The composition of the water used in these tests is given in Table IV.

The results are shown in Table V. The corrosion rates of the heat-transfer Admiralty brass tubes show the cumulative corrosion which occurred during the 7-day test period. As can be seen, pentyloxybenzotriazole gave over 90 percent corrosion protection and the hexyloxybenzotriazole gave over 85 percent corrosion protection.

TABLE IV

WATER COMPOSITION USED IN THE CHLORINE CHEMICAL RESISTANCE EXAMPLES 6–9

| Ion | Concentration (mg/L) |
|---|---|
| Ca | 88 |
| Mg | 24 |
| Cl | 70 |
| $SO_4$ | 325 |
| pH | 7.5 |

By contrast, tolyltriazole, which is a widely used inhibitor, gave only 36 percent corrosion protection. Also, the immersed copper probes treated with either pentyloxybenzotriazole or hexyloxyl benzotriazole were not significantly affected by exposure to chlorine over the 1 hour contact time while the copper probes treated with tolyltriazole or the blank experienced dramatically higher corrosion rates in the presence of chlorine.

TABLE V

EFFECT OF CHLORINATION ON CORROSION RATES OF HEAT-TRANSFER ADMIRALTY BRASS TUBES AND IMMERSED COPPER PROBES

| Ex. No. | Inhibitor | Conc. mg/L | Corrosion Protection of Admiralty Brass Tubes (wt. loss) | % Protection* | Corrosion Rates (mpy): Copper-Probe Corrosion Rates during $Cl_2$ Contact for the Final Chlorination: 5 min. | 15 min. | 30 min. | 60 min. | Recovery Corrosion Rate After the Final Chlorination |
|---|---|---|---|---|---|---|---|---|---|
| 5 | None | 0 | 3.45 | 0 | — | 5.5 | 5.0 | 3.0 | 1.5 |
| 6 | Hexyloxy Benzotriazole | 10 | 0.50 | 86 | 0.005 | 0.005 | 0.01 | 0.02 | 0.005 |

TABLE V-continued

EFFECT OF CHLORINATION ON CORROSION RATES OF HEAT-TRANSFER ADMIRALTY BRASS TUBES AND IMMERSED COPPER PROBES

| Ex. No. | Inhibitor | Conc. mg/L | Corrosion Protection of Admiralty Brass Tubes (wt. loss) | % Protection* | Corrosion Rates (mpy) Copper-Probe Corrosion Rates during $Cl_2$ Contact for the Final Chlorination 5 min. | 15 min. | 30 min. | 60 min. | Recovery Corrosion Rate After the Final Chlorination |
|---|---|---|---|---|---|---|---|---|---|
| 7 | Pentyloxy Benzotriazole | 5 | 0.30 | 91 | 0.02 | 0.02 | 0.02 | 0.03 | 0.005 |
| 8 | Tolyltriazole | 5 | 2.2 | 36 | 0.9 | 2.0 | 2.0 | 2.0 | 1.0 |

*% Protection = $\frac{\text{blank} - \text{inhibited}}{\text{blank}} \times 100\%$

EXAMPLES 9-10

Dynamic Pilot Cooling Tower Tests

These examples illustrate the outstanding chlorine resistance and film persistency of pentyloxybenzotriazole in a dynamic system which simulate the operational variations commonly found in industrial cooling towers. Operational factors simulated include blowdown, heat transfer surfaces, dynamic flow, evaporative-cooling, cycles of concentration, and customary chlorination practices.

The pilot cooling tower system used contained two single tube heat exchangers. Cooling water flowed in series through the shell side (annular space) of the heat exchangers and hot water was circulated through the tubes in series, counterflow. In addition to the main recirculation circuit through the cooling tower, the system also contained a recycle loop from the outlet of the No. 2 Heat Exchanger to the inlet of the No. 1 Heat Exchanger for the purpose of maintaining cooling water linear velocity in the heat exchangers. The heat exchanger shells were fabricated of Plexiglass to permit observation of the heat exchanger surfaces during the test run. For these tests, a 90/10 copper/nickel tube was placed in the No. 2 Heat Exchanger.

Instrumentation for monitoring and control of test variables included a pH and conductivity indicator/-controller, PAIR corrosion rate indicators, a temperature indicator/controller, and rotometers for air and water flows.

PAIR probes for continuous monitoring of 90/10 copper/nickel corrosion rates were installed after the outlet of the No. 2 Heat Exchanger. A corrosion test coupon of 90/10 copper/nickel was installed in the recycle loop. The PAIR cells and the corrosion test loop were fabricated of Plexiglass to permit observation of the Corrater electrodes and the corrosion coupons.

The cleaning procedures employed to prepare tubes, corrosion coupons and PAIR electrodes for use in these tests are described in ASTM standard G1-81.

In preparation for these tests, stainless steel tubes were installed in the heat exchangers and the system was filled with makeup water. The system required three days for the recirculating water to concentrate to the target cycles of concentration. The target water composition was the same for Examples 5-8. After the target cycles were reached, the stainless steel tubes were removed and the test specimens installed (tubes, coupons, and PAIR electrodes). At this time, blowdown commenced and the desired copper inhibitor was added. The inhibitor was allowed to deplete by gradually replacing the cooling water. Thus, after three days, less than one-eighth of the original inhibitor concentration was present, and after five days, practically no inhibitor remained.

Table VI shows the corrosion rate just prior to the addition of chlorine to the system and the maximum corrosion rate recorded while chlorine was present. Chlorine was added so that between 0.2 mg/L to 0.5 mg/L free residual of chlorine was present. The chlorine concentration was then allowed to dissipate through blow-down, evaporation, and reaction.

As can be seen in Table VI, pentoxybenzotriazole effectively passivated the 90/10 copper/nickel specimens and dramtically reduced the aggressiveness of chlorine even, surprisingly, when all of the inhibitor had depleted.

EXAMPLES 11-12

Film Persistency

The experimental procedure of Examples 9-10 was used. However, no chlorine was added to the system. The purpose of this test was to determine the persistency of the protective film formed by the inhibitor after the inhibitor had been exhausted from the system due to replacement of the original water.

The results are shown in Table VII, which shows that pentoxybenzotriazole provided durable protection throughout the two week test. This is especially surprising in view of the practically complete depletion of original inhibitor concentration by the fifth day. The test was terminated after two weeks only due to practical limitations of time and expense.

TABLE VI

PILOT COOLING TOWER TEST WITH CHLORINATION: EFFECTIVENESS OF PENTYLOXYBENZOTRIAZOLE
Corrosion Rates (mpy) on Cu/Ni 90/10

| Day | Example 9 Control (No Inhibitor) Rate Prior to Chlorination | Max. Rate In Presence of $Cl_2$ | Example 10 5 mg/L Pentyloxy BT Initial Charge Rate Prior to Chlorination | Max. Rate In Presence of $Cl_2$ |
|---|---|---|---|---|
| 1 | 2.0 | No $Cl_2$ Added | 0.05 | No $Cl_2$ Added |
| 2 | 2.0 | No $Cl_2$ Added | 0.05 | No $Cl_2$ Added |
| 3* | 1.5 | 7.8 | 0.05 | 0.05 |
| 4* | 0.9 | 5.8 | 0.05 | 0.05 |
| 5* | 0.7 | 2.8 | 0.05 | 0.08 |
| 6* | 0.5 | 2.3 | 0.07 | 0.30 |
| 7* | 0.7 | 1.7 | 0.10 | 0.70 |
| Tube appearance uniformly darkened after Day 7 | | | Bright, very slight tarnish | |

*Chlorine was added to the system on the indicated days.

TABLE VII

| Inhibition Persistency of Pentyloxybenzotriazole In the Pilot Cooling Tower | | |
|---|---|---|
| Day | Example 11 Blank (no inhibitor) | Example 12 Pentyloxybenzotriazole 5 mg/L Initial Charge |
| 0 | 13 | 7 |
| 1 | 5 | 0.1 |
| 2 | 3.5 | 0.05 |
| 3 | 2.5 | 0.03 |
| 4 | 2.5 | 0.03 |
| 5 | 2.5 | 0.03 |
| 6 | 2.0 | 0.03 |
| 7 | 2.0 | 0.03 |
| 8 | 2.0 | 0.03 |
| 9 | 2.0 | 0.03 |
| 10 | 2.0 | 0.03 |
| 11 | 1.8 | 0.03 |
| 12 | 2.0 | 0.05 |
| 13 | 1.5 | 0.05 |
| 14 | 1.4 | 0.05 |

What is claimed is:

1. A method of inhibiting corrosion in an aqueous system which is in contact with a metallic surface, comprising adding to said system an effective amount of a compound selected from the group of compounds having the following formula:

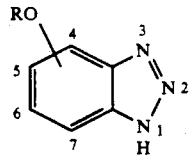

wherein RO is positioned at 4, 5, 6, or 7, and wherein R is a substituted or unsubstituted, straight or branched chain $C_3$–$C_{18}$ alkyl.

2. The method of claim 1, wherein about 0.1 to about 10.0 mg/l of said compound is added to said aqueous system.

3. The method of claim 1, wherein said compound is selected from the group consisting of butyloxybenzotriazole, pentyloxybenzotriazole and hexyloxybenzotriazole.

4. The method of claim 2, wherein said compound is selected from the group consisting of butyloxybenzotriazole, pentoxybenzotriazole and hexyloxybenzotriazole.

5. The method of claim 1, wherein said metallic surface is a copper or copper alloy surface.

6. The method of claim 2, wherein said surface is a copper or copper alloy surface.

* * * * *